US007049522B2

(12) United States Patent
Kim et al.

(10) Patent No.: US 7,049,522 B2
(45) Date of Patent: May 23, 2006

(54) LIGHTWEIGHT COMPOSITE ELECTRICAL CONDUCTORS AND CABLES INCORPORATING SAME

(75) Inventors: Young Joon Kim, Greenfield, MA (US); Jun Hong Yi, Greenfield, MA (US); James E. Zellmann, Montague, MA (US)

(73) Assignee: Judd Wire, Inc., Turners Falls, MA (US)

( * ) Notice: Subject to any disclaimer, the term of this patent is extended or adjusted under 35 U.S.C. 154(b) by 0 days.

(21) Appl. No.: 11/077,294

(22) Filed: Mar. 9, 2005

(65) Prior Publication Data

US 2005/0199414 A1 Sep. 15, 2005

Related U.S. Application Data

(60) Provisional application No. 60/552,091, filed on Mar. 10, 2004.

(51) Int. Cl.
*H01B 7/00* (2006.01)

(52) U.S. Cl. ..... 174/110 R

(58) Field of Classification Search ..... 174/110 R, 174/110 FC, 110 N, 113 R, 116, 119 R, 120 R
See application file for complete search history.

(56) References Cited

U.S. PATENT DOCUMENTS

| | | | | |
|---|---|---|---|---|
| 3,699,237 | A * | 10/1972 | Melia | 174/101.5 |
| 4,952,012 | A * | 8/1990 | Stamnitz | 385/101 |
| 4,966,801 | A * | 10/1990 | Becker et al. | 428/113 |
| 5,012,045 | A | 4/1991 | Sato | |
| 5,220,133 | A | 6/1993 | Sutherland et al. | |
| 5,521,009 | A * | 5/1996 | Ishikawa et al. | 428/375 |
| 5,539,849 | A * | 7/1996 | Petisce | 385/102 |
| 5,654,098 | A | 8/1997 | Aono et al. | |
| 5,777,273 | A * | 7/1998 | Woody et al. | 174/113 R |
| 6,424,768 | B1 * | 7/2002 | Booth et al. | 385/102 |
| 6,674,011 | B1 | 1/2004 | Ueno et al. | |
| 6,692,842 | B1 | 2/2004 | McCullough et al. | |

OTHER PUBLICATIONS

C & M Corporation, Engineering Design Guide, 3rd Edition, pp. 1-7, Jan. 1992.*

* cited by examiner

*Primary Examiner*—William H. Mayo, III
(74) *Attorney, Agent, or Firm*—Holland & Bonzagni, P.C.; Mary R. Bonzagni, Esq.

(57) ABSTRACT

Lightweight composite electrical conductors made up of a plastic matrix or plastic core, a plurality of electrical conductors either embedded within the plastic matrix or circumferentially surrounding an outer surface of the plastic core, and at least one insulating layer, as well as, cables incorporating one or more of these conductors, are provided. The inventive composite conductors and cables are particularly useful for automotive and aircraft wire and cable.

28 Claims, 1 Drawing Sheet

LIGHTWEIGHT COMPOSITE ELECTRICAL CONDUCTORS AND CABLES INCORPORATING SAME

RELATED APPLICATION

This application claims priority from U.S. Provisional Patent Application Ser. No. 60/552,091, filed Mar. 10, 2004.

TECHNICAL FIELD OF THE INVENTION

The present invention basically relates to composite electrical conductors having a desirable combination of excellent tensile strength, acceptable levels of current carrying capacity, reduced weight and preferably, high temperature resistance. As such, these composite conductors are particularly useful for automotive and aircraft wire and cable.

BACKGROUND OF THE INVENTION

In automotive and aircraft wire and cable applications, weight reduction is deemed highly desirable due to the long lasting and positive impact it has on the performance (e.g., speed, fuel economy), as well as the cost of the vehicle in question. This is especially true in racing applications, where fractions of a second can mean winning or losing a race. Weight, therefore, is an important, if not critical factor in the overall design of wire and cable products for these applications.

In addition to the desirable property of being lightweight, insulated electrical wire products used in automotive and aircraft applications must also satisfy rigorous mandatory requirements that include, but are not limited to, high temperature resistance, high tensile strength, and adequate current carrying capacity.

A need continues to exist for lighter weight electrical conductors that qualify for higher use-temperatures, while demonstrating excellent tensile strength and while providing acceptable levels of current carrying capacity.

It is therefore an object of the present invention to provide such a lightweight conductor.

It is a more particular object to provide a composite electrical conductor that employs a plastic core or matrix for improving the strength while reducing the weight of the resulting conductor.

It is a further object of the present invention to provide a cable that employs one or more such composite conductors.

SUMMARY

The present invention therefore provides a lightweight composite electrical conductor that comprises:

(a) a plastic matrix or plastic core;

(b) a plurality of electrical conductors either embedded within the plastic matrix or circumferentially surrounding the plastic core; and (c) at least one insulating layer circumferentially surrounding the plastic matrix or the plurality of electrical conductors.

The present invention also provides a cable incorporating one or more composite electrical conductors, as described above.

Other features and advantages of the invention will be apparent to one of ordinary skill from the following detailed description and accompanying drawings.

Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods, and examples are illustrative only and not intended to be limiting.

BRIEF DESCRIPTION OF THE DRAWINGS

In the course of the description which follows, reference is made to the drawings, in which.

BEST MODE FOR CARRYING OUT THE INVENTION

The composite electrical conductor of the present invention has a desirable combination of excellent tensile strength, acceptable levels of current carrying capacity, reduced weight and preferably, high temperature resistance.

As will be readily appreciated by those skilled in the art, conductors that match the dimensions of prior art conductors have the added benefit of being suitable for use with existing coupling means or connectors. The present inventors have, therefore, directed their efforts toward designing a reduced weight composite conductor that not only demonstrates the combination of properties noted above but, in a preferred embodiment, matches the physical dimensions of prior art conductors, rendering it suitable for use with conventional connectors.

As will also be readily appreciated by those skilled in the art, the plastic core or plastic matrix of the above-referenced composite conductor uses space that could have been occupied by additional electrical conductors, thereby reducing the current carrying capacity of these conductors. By way of the present invention, it has been discovered that such reduced current carrying capacities are not a disadvantage in that these conductors continue to be suitable for use in a large percentage of the signal transmitting circuits in transportation equipment such as aircraft and automobiles, which are able to operate at substantially reduced current levels.

Figure 1:
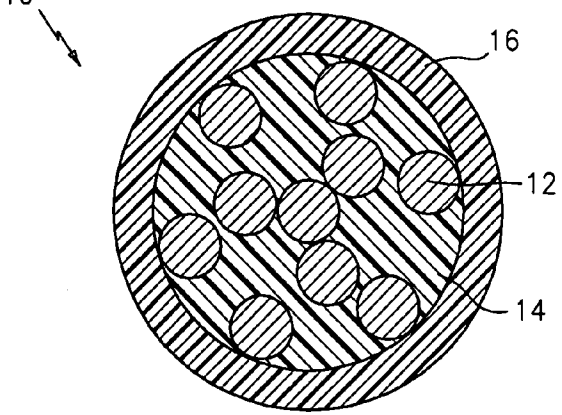
FIG. 1 is a cross-sectional view of one embodiment of the composite electrical conductor of the present invention that employs a plastic matrix.

Referring now to FIG. 1 in detail, reference numeral 10 has been used to generally designate one embodiment of the composite electrical conductor of the present invention. In this embodiment, composite electrical conductor 10 basically comprises a plurality of substantially continuous, longitudinally positioned and stranded conductive materials 12 embedded within a plastic matrix 14 in either an ordered or random fashion, and a layer of insulating material 16 circumferentially surrounding the matrix 14.

Plastic materials suitable for use in matrix 14 are flexible, flame resistant plastic materials. For higher-use temperatures (e.g., ≧150° C.), suitable materials include thermoplastic fluoropolymers such as ethylene-tetrafluoroethylene (ETFE) copolymers and fluorinated ethylene-propylene (FEP) and perfluoroalkoxy (PFA) resins. For lower-use temperatures (e.g., <150° C.), polyesters, polyamides, and polyolefins may be used provided flame-retardants and preferably antioxidants are incorporated into these materials to impart flame retardant and anti-aging properties.

The outer diameter of plastic matrix 14, in this one embodiment, ranges from about 0.35 to about 0.90 millimeters (mm), and preferably ranges from about 0.50 to about 0.65 mm.

Figure 2:
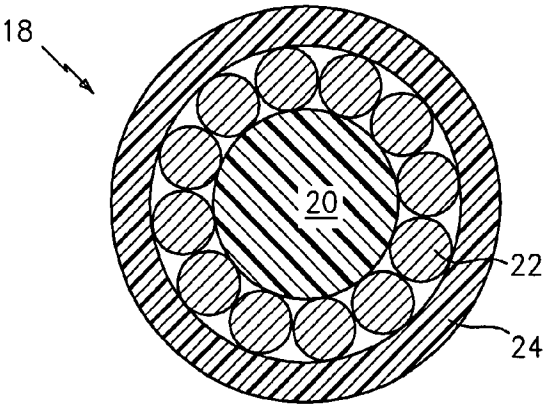
FIG. 2 is a cross-sectional view of a preferred embodiment of the inventive composite conductor that employs a solid or substantially solid plastic core.
Figure 3:
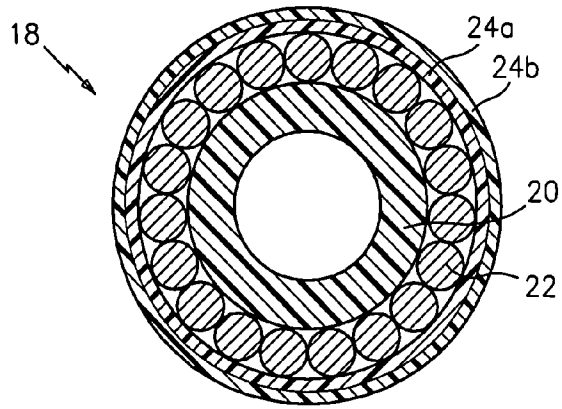
FIG. 3 is a cross-sectional view of another preferred embodiment of the inventive composite conductor that employs a hollow tubular plastic core.
Figure 4:
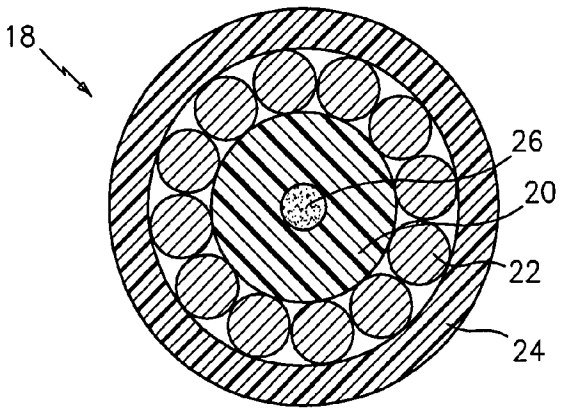
FIG. 4 is a cross-sectional view of yet another preferred embodiment of the inventive conductor that employs a fibrous strength member with a hollow tubular plastic core.

In FIGS. 2 to 4, reference numeral 18 has been used to generally designate a more preferred embodiment of the inventive composite conductor. In this more preferred embodiment, conductor 18 comprises a plastic core 20, a plurality of substantially continuous, longitudinally positioned and stranded conductive materials 22 arranged in a layer that circumferentially surrounds the plastic core 20, and a layer of insulating material 24.

The plastic core 20 of conductor 18 is a relatively stiff or rigid solid, substantially solid, or hollow tubular structure that extends along the length of conductor 18 and may adopt any cross-sectional shape (e.g., circular, triangular, square). Plastic materials suitable for use in forming plastic core 20 are strong and relatively stiff materials that demonstrate high temperature resistance (i.e., maintain substantial tensile strength and deformation resistance at temperatures of up to about 150° C.). Examples of such materials include liquid crystal polymers, polyether ether ketone (PEEK), polyether sulfone, polyimide and polyimide-amide plastic materials.

In one such more preferred embodiment, which is shown in FIG. 2, the plastic core 20 is a relatively stiff solid structure having a generally circular cross-section that is formed using one or more PEEK resins. PEEK resins, which are exceptionally strong, have excellent tensile properties, demonstrate high temperature resistance, and are inherently flame retardant, are available from Zeus Industrial Products, 3737 Industrial Blvd., Orangeburg, S.C. 29118 USA and Zyex Ltd., Stonedale Road, Stonehouse, United Kingdom, GL10 3RQ ("Zyex"). The PEEK resin(s) is preferably extruded into a relatively stiff or rigid solid structure using known techniques.

In another such embodiment, which is shown in FIG. 3, the plastic core 20 is a hollow tubular structure. As will be readily appreciated by those skilled in the art, the use of a hollow tubular plastic core allows for an increase in the size of conductor 18 for the purpose of, for example, lowering operating temperatures due to resistance heating, without a detrimental marked increase in the weight of the conductor.

In yet another such embodiment, which is shown in FIG. 4, a fibrous strength member 26 is used in conjunction with hollow tubular plastic core 20 to further strengthen composite conductor 18. Fibrous strength member 26 may also be incorporated within solid or substantially solid plastic core 20 to further strengthen conductor 18. Fibrous materials suitable for use in preparing strength member 26 include, but are not limited to, aramid fibers, polyamide fibers, polyester fibers, and mixtures thereof. These fibrous materials may be used alone or in conjunction with other non-fibrous materials to further strengthen plastic core 20. Aramid yarns or fibers are sold by E. I. du Pont de Nemours and Company, 1007 Market Street, Wilmington, Del. 19898 ("DuPont"), under the trade designations KEVLAR® and NOMEX® synthetic aramid fibers, and by Teijin Shoji (USA), 42 W 39th St. Fl. 6, New York, N.Y. 10018-3809, USA, under the trade designation TECHNORA® para-aramid fiber, while polyamide fibers are sold by DuPont, under the trade designation LYCRA™ polyamide fibers. Polyester fibers are available from Honeywell International Inc., 101 Columbia Road, Morristown, N.J. 07962, under the trade designation DSP™ polyester fibers. In this more preferred embodiment, a PEEK resin is preferably extruded onto strength member 26 using known techniques to form a fiber reinforced plastic core 20.

The outer diameter of the plastic core 20, in these more preferred embodiments, may range from either from about 0.25 to about 1.00 mm (preferably, from about 0.30 to about 0.40 mm) for smaller sized conductors, or from about 2.80 to about 15.00 mm (preferably, from about 4.19 to about 11.28 mm) for larger sized conductors.

The plurality of electrical conductors 12, 22 used in the embodiments described above are stranded conductive materials that include stranded copper, copper alloys, nickel, nickel-clad copper, nickel-plated copper, silver, silver-plated copper, tin-plated copper and tin.

In a preferred embodiment, the electrical conductors 12, 22 are prepared from stranded copper with tin plating. The tin plating is applied by electroplating (or hot-dipping) a uniform thickness of high purity tin to the individual copper wires comprising the strand. The tin plate is intended to protect the underlying stranded copper from oxidation effects. Also, the tin plating helps improve the integrity of electrical connections.

In the embodiment generally shown in FIG. 1, electrical conductors or strands 12 are embedded within the plastic matrix 14 in either an ordered or random fashion, while in the more preferred embodiments generally shown in FIGS. 2 to 4, the plastic core 20 is surrounded by one or more layers of helically wound strands 22 in a fixed round geometric arrangement. It is noted that for multi-layer embodiments, the strands 22 may have a unilay construction, where successive layers have the same lay direction and lay length. Another multi-layer embodiment adopts a concentric configuration in which the strands 22 of one layer are helically or spirally wound in one direction, while the strands 22 of a contiguous layer are wound in the opposite direction.

The thickness of the layer(s) formed by the strands 22, in the more preferred embodiments of the present invention, may range from either from about 0.10 to about 0.32 mm (preferably, from about 0.13 to about 0.20 mm) for smaller sized conductors, or from about 0.28 to about 3.00 mm (preferably, from about 0.58 to about 2.30 mm) for larger sized conductors.

Insulating layer 16, 24 serves as a protective shield and is applied directly to the outer surface of the polymer matrix 14, or to the layer(s) formed by electrical conductors or strands 22.

Insulating layer 16, 24 is preferably a fluoropolymer layer formed by either (1) extruding a fluoropolymer material along a portion or length of the polymer matrix 14, or the layer(s) formed by electrical conductors or strands 22, or (2) wrapping a fluoropolymer film, in an overlapping fashion, along the length of the polymer matrix 14, or conductor layer(s).

Fluoropolymers which may advantageously be utilized in insulating layer 16, 24 of the composite electrical conductor 10, 18 include, perfluoromethylvinylether (MFA), perfluoroalkoxy (PFA), polytetrafluoroethylene (PTFE), ethylene-chlorotrifluoroethylene (ECTFE) copolymers, ethylene-tetrafluoroethylene (ETFE) copolymers and terpolymers, polyvinylidene fluoride (PVDF), tetrafluoroethylene-hexafluoropropylene-vinylidene fluoride (THV), polyvinylfluoride (PVF) resins, and mixtures thereof.

The fluoropolymer of insulating layer 16, 24, in a preferred embodiment, is an ETFE copolymer which comprises 35 to 60 mole % (preferably 40 to 50 mole %) of units derived from ethylene, 35 to 60 mole % (preferably 50 to 55 mole %) of units derived from tetrafluoroethylene and up to 10 mole % (preferably 2 mole %) of units derived from one or more fluorinated comonomers (e.g., HFP, HFIB, PFBE, VDF and VF). Such copolymers are available from DuPont under the trade designation TEFZEL HT 200, and from Daikin America, Inc. ("Daikin"), Orangeburg, N.Y., under the trade designation NEOFLON EP-541.

In a more preferred embodiment, insulating layer 16, 24 is extruded and the fluoropolymer(s) contains (as extruded) from about 4 to about 16% by weight of a crosslinking agent. Preferred crosslinking agents are radiation crosslinking agents that contain multiple carbon-carbon double bonds.

In yet a more preferred embodiment, crosslinking agents containing at least two allyl groups and more preferably, three or four allyl groups, are employed. Particularly preferred crosslinking agents are triallyl isocyanurate (TAIC), triallylcyanurate (TAC) and trimethallylisocyanurate (TMAIC).

In yet a more preferred embodiment, the fluoropolymer(s) contains a photosensitive substance (e.g., titanium dioxide), which renders the insulating layer 16, 24 receptive to laser marking. The term "laser marking," as used herein, is intended to mean a method of marking an insulated conductor using an intense source of ultraviolet or visible radiation, preferably a laser source. In accordance with this method, exposure of the fluoropolymer insulating layer 16, 24 to such intense radiation will result in a darkening where the radiation was incident. By controlling the pattern of incidence, marks such as letters and numbers can be formed.

In yet a more preferred embodiment, the fluoropolymer(s) contains from about 1 to about 4% by weight, of titanium dioxide.

In addition to the above component(s), the fluoropolymer(s) may advantageously contain other additives such as pigments (e.g., titanium oxide), lubricants (e.g., PTFE powder), antioxidants, stabilizers, flame retardants (e.g., antimony oxide), fibers, mineral fibers, dyes, plasticizers and the like. However, some such additives may have an adverse effect on the desirable properties of the composite electrical conductor 10, 18 of the present invention.

The components of the insulating layer may be blended together by any conventional process until a uniform mix is obtained. In a preferred embodiment, a twin-screw extruder is used for compounding. The insulating layer 16, 24 is preferably formed by melt-extrusion, and then crosslinked using known techniques, which include beta and gamma radiation crosslinking methods.

In another preferred embodiment, insulating layer 16, 24 is formed by wrapping a fluoropolymer film, in an overlapping fashion, along the length of the polymer matrix 14, or conductor layer(s). The fluoropolymer film may be a heat-sealed or a non-heat-sealed fluoropolymer film. It is noted that wrapped fluoropolymer tapes or films will fuse or bond to themselves in overlapping regions at temperatures at or above the melting point of the fluoropolymer, thereby obviating the need to employ a heat-sealable adhesive with such films.

The thickness of insulating layer(s) 16, 24 of the composite electrical conductor 10, 18 may range from about 0.05 to about 0.30 mm (preferably, from about 0.10 to about 0.21 mm) for smaller sized conductors, or from about 0.20 to about 0.50 mm (preferably, from about 0.25 to about 0.41 mm) for larger sized conductors.

Composite electrical conductor 18, in one more preferred embodiment, comprises: a solid plastic core 20 prepared from one or more PEEK resins; a plurality of stranded tin-plated copper wires 22 contained in a single layer that circumferentially surrounds the plastic core 20; and an extruded, crosslinked ETFE insulating layer 24 circumferentially surrounding the layer formed by electrical conductors or strands 22.

This more preferred embodiment of composite conductor 18, when sized to 24 American Wire Gage (AWG), may be prepared by wrapping eleven strands of tin-plated copper wire, each having a diameter of 0.128 mm, around a solid PEEK plastic core having a diameter of 0.35 mm, using a multi-stranding machine. Lay lengths of the strand-winding around the core preferably range from about 0.34 to about 0.36 mm, with strand winding preferably done with a left-hand lay. A quantity of ETFE is then extruded over the copper wire layer using conventional extrusion techniques and the resulting assembly exposed to approximately 18 megarads of electron beam irradiation to crosslink the ETFE layer.

In another more preferred embodiment of composite electrical conductor 18 , plastic core 20 is a hollow tubular PEEK plastic core, and (as shown in FIG. 3) the insulating layer consists of two layers 24*a*, 24*b*, while in yet another more preferred embodiment, a plurality of KEVLAR® or NOMEX® fibers are used in conjunction with the hollow tubular PEEK plastic core to further strengthen composite conductor 18.

The composite electrical conductor 10, 18 of the present invention is lightweight, and preferably may be used in environments where temperatures exceed 150° C. In addition, the inventive conductor 10, 18 demonstrates excellent tensile strength and acceptable levels of current carrying capacity.

Composite conductor 10, 18 has an outer diameter that may range either from about 0.40 to about 1.62 mm (preferably, from about 0.56 to about 0.80 mm) for smaller sized conductors, or from about 3.28 to about 18.50 mm (preferably, from about 5.35 to about 15.88 mm) for larger sized conductors, and weighs from about 1.0 to about 7.0 kilograms (kg) per kilometer (km) (preferably, from about 1.2 to about 4.0 kg/km) for smaller sized conductors, or from about 11.5 to about 950 kg/km (preferably, from about 15.5 to about 609 kg/km) for larger sized conductors.

Preferred embodiments of the composite conductor 10, 18 of the present invention qualify for use temperatures ranging from about −65° C. to about 260° C.

In addition to the above, preliminary test results indicate that the composite conductor 10, 18 of the present invention demonstrates improved breaking strength (ASTM B246-00) and acceptable levels of electrical resistance (ASTM B193-01) when compared to similarly sized conventional wire products. Further testing has indicated that the pull off tensile load for the composite conductor 10, 18 with crimp setting no. 24 greatly exceeds the minimum pull off load of 36 Newtons for #24 AWG Crimp (as required in Military Specification MIL-C-39029 entitled "Contacts, Electrical Connector, General Specification for," and dated May 2, 1988).

The subject invention will now be described by reference to the following illustrative examples. The examples are not, however, intended to limit the generally broad scope of the present invention.

WORKING EXAMPLES

Components Used

In the Working Examples set forth below, the following components and materials were used:

PEEK CORE: a solid PEEK elongate structure having a circular cross-section and diameter of 0.40 mm, which was purchased from Zyex under the product designation ZYEX PEEK Monofilament.

CONDUCTOR: 24 AWG tin-plated copper prepared at Judd Wire Inc. by drawing from ¼ inch diameter copper rod purchased from Phelps Dodge Corporation, One North Central Avenue, Phoenix, Ariz. 85004, and then by tin-plating the drawn copper using a hot-dipping technique.

ETFE: a copolymer comprising 35 to 60 mole % of ethylene; 60 to 35 mole % of tetrafluoroethylene; and up to 10 mole % of a fluorinated termonomer, marketed under the trade designation TEFZEL HT 200 fluoropolymer resin, by DuPont.

TAIC: a triallyl isocyanurate crosslinking agent, marketed under the designation TAIC triallyl isocyanurate, by Nippon Kasei Chemical Co., Ltd., Tokyo, Japan.

$TiO_2$: titanium dioxide pigment in powder form (96% in purity), marketed under the trade designation TIPURE titanium dioxide pigment, by DuPont. Commercial Wire Products Conductor I: a stranded tin plated copper conductor (24 American Wire Gage (AWG), 19 Strand, tin plated copper) measuring 0.589 millimeters in diameter, with a crosslinked ETFE insulation layer having a thickness of 0.15 millimeters.

Conductor II: a stranded tin plated copper conductor (30 American Wire Gage (AWG), 7 Strand, tin plated copper) measuring 0.310 millimeters in diameter, with a crosslinked ETFE insulation layer having a thickness of 0.15 millimeters.

Conductor III: a stranded tin plated copper conductor (24 American Wire Gage (AWG), 19 Strand, tin plated copper) measuring 0.60 millimeters in diameter, with a crosslinked ETFE insulation layer having a thickness of 0.12 millimeters.

Sample Preparation

Examples 1 and 2

Eleven CONDUCTORs were wrapped around the PEEK CORE using a WATSON (model number HK-630L) multi-stranding machine. Lay length of the strand-winding around the core, which was done with a left-hand lay, was 9.6 mm.

A quantity of ETFE was compounded with 8% by wt. TAIC and 2% by wt. $TiO_2$ and was then extruded over the layer of ELECTRICAL CONDUCTORs using a single-screw extruder having four heating zones which were set at 200° C., 240° C., 275° C., and 290° C., respectively. The thickness of the extruded ETFE layer was 0.15 millimeters.

Test samples were then irradiated using electron-beam radiation, with air-cooling. Total beam dosage was 18 megarads, while the applied voltage was 800 kilovolts (KV).

The subject wire constructions are described in Tables 1 and 2, hereinbelow.

The prepared test samples and Commercial Wire Products were then subjected to the test procedures identified below.

Test Methods

Breaking Strength: ASTM B246-00

Electrical Resistance: ASTM B193-01

Pull Off Tensile Load: For this test, a HOUNSFIELD Tensile Test Machine with a 500 Newton load cell was used. A drop clock was first set up under a lower arm of the HOUNSFIELD Tensile Test Machine, which allowed for the elongation of each sample to be measured and also allowed for the lower arm (active arm during test) to be returned to the same position for each test.

Sample lengths of 145 mm each were used.

The pull rate of the HOUNSFIELD Tensile Test Machine was set to 5% of full-scale deflection (25 mm per minute). The sample to be tested was mounted in the self-gripping jaws of the HOUNSFIELD Tensile Test Machine and the machine activated and operated until a load of less than 1 Newton was read and the drop clock zeroed. The machine was then run until the sample failed and the peak tensile load recorded. The machine was then halted and the elongation recorded and converted to metric units. All samples were tested followed by the testing of two standard wires to confirm the accuracy and reliability of the subject test method and tensile test machine.

Pull off Force was reported in Newtons, while Extension was reported in millimeters.

Example 1 and Comparative Examples

For these examples, the prepared composite electrical conductor samples and Conductors I and II were tested for breaking strength and electrical resistance. The results are set forth in Table 1, hereinbelow.

TABLE 1

Summary of Example 1 and Conductors I and II

| Example | 1 | Conductor I | Conductor II |
|---|---|---|---|
| Electrical Conductor | 24 AWG Tin-plated copper PEEK core | 24 AWG Tin-plated copper | 30 AWG Tin-plated copper |
| Insulation | Crosslinked ETFE | Crosslinked ETFE | Crosslinked ETFE |
| Insulation thickness (mm) | 0.15 | 0.15 | 0.15 |
| Overall Diameter (mm) | 0.965 | 0.889 | 0.610 |
| Weight (kg/km) | 2.24 | 2.75 | 0.909 |
| Breaking Strength (Newton) | 142 | 102 | 93.4 |
| Electrical Resistance (ohms/km) | 117 | 81.0 | 304 |

The results shown in Table 1, demonstrate that the composite conductor of the present invention (Example 1) achieves a level of current carrying capacity that is acceptable for signal transmitting circuits. More specifically, signal transmitting circuits need only the current carrying capacity of 30 AWG wires or conductors. As such, conductors having electrical resistance levels as high as 375% of conventional 24 AWG wires or conductors will function properly in these circuits. The electrical resistance level of Example 1 is only 145% of Conductor I (24 AWG tin-plated copper), which means that it has more current carrying capacity than these circuits require. In addition, it is noted that the inventive composite conductor increases wire breaking strength by approximately 39%, while reducing weight by approximately 20%, when compared to similarly sized Conductor I.

Example 2 and Comparative Example

For these examples, the prepared composite electrical conductor samples and Conductor III were tested for pull off tensile load. The results are set forth in Table 2, hereinbelow.

TABLE 2

Summary of Example 2 and Conductor III

| | | Crime Setting No. 22 | | Crime Selling No. 24 | | Crime Selling No. 26 | |
|---|---|---|---|---|---|---|---|
| Example | Contact Type | Pull Off Force (N) | Extension (mm) | Pull Off Force (N) | Extension (mm) | Pull Off Force (N) | Extension (mm) |
| 2 | AS-22 | 70.1 | 26.2 | 67.7 | 25.0 | 41.0 | 6.5 |
| | | 68.8 | 25.0 | 69.4 | 25.6 | 41.0 | 6.5 |
| | ASC | 56.1 | 20.0 | 68.5 | 25.4 | 67.9 | 24.1 |
| | | 62.4 | 23.4 | 65.2 | 24.5 | 70.0 | 27.9 |
| | ASL | 68.7 | 25.9 | 70.4 | 33.0 | 42.1 | 4.0 |
| | | 72.5 | 35.6 | 69.9 | 25.0 | 54.6 | 14.7 |
| | ASL | 70.0 | 31.75 | 68.2 | 27.6 | — | — |
| | | 73.7 | 31.70 | 70.3 | 30.0 | — | — |
| Conductor III | AS-22 | 92.7 | 14.6 | 88.7 | 5.8 | 77.6 | 3.4 |
| | | 91.6 | 7.6 | 88.4 | 4.1 | 84.6 | 4.6 |
| | ASC | 90.6 | 4.8 | 91.3 | 5.6 | 91.2 | 4.2 |
| | | 90.2 | 4.7 | 91.3 | 6.3 | 89.9[1] | 4.8 |
| | ASL | 93.0 | 6.2 | 89.2 | 6.1 | 79.2 | 4.4 |
| | | 92.0 | 5.5 | 88.9 | 4.1 | 82.5 | 3.8 |
| | ASL | 86.3 | 6.35 | 87.0 | 6.35 | — | — |
| | | 93.7 | 19.0 | 90.8 | 5.97 | — | — |

[1]Sample Lost

The results shown in Table 2 generally demonstrate the strength of the composite electrical conductor of the present invention (Example 2), with composite conductors with crimp setting no. 24 generating the most reliable and consistent results. In fact, the pull off tensile load for the composite conductor with crimp setting no. 24 greatly exceeded the minimum pull off load of 36 Newtons for #24 AWG Crimp (as required in Military Specification MIL-C-39029 entitled "Contacts, Electrical Connector, General Specification," and dated May 2, 1988).

Although the present invention has been shown and described with respect to detailed embodiments thereof, it will be understood by those skilled in the art that various changes in form and detail thereof may be made without departing from the spirit and scope of the claimed invention.

Having thus described the invention, what is claimed is:

1. A lightweight composite electrical conductor that consists essentially of:

(a) a plastic matrix or plastic core;

(b) a plurality of electrical conductors either (i) embedded and fixed in place within the plastic matrix or (ii) circumferentially surrounding an outer surface of the plastic core, wherein at least some of the electrical conductors circumferentially surround and touch the outer surface of the plastic core; and (c) at least one insulating layer circumferentially surrounding the plastic matrix or the plurality of electrical conductors.

2. The lightweight composite electrical conductor of claim 1, which comprises: a plastic matrix; a plurality of electrical conductors embedded and fixed in place within the plastic matrix; and at least one insulating layer circumferentially surrounding the plastic matrix.

3. The lightweight composite electrical conductor of claim 2, wherein the plastic matrix is prepared from a material selected from the group of fluoropolymers, polyamides, polyesters, polyolefins, and combinations thereof.

4. The lightweight composite electrical conductor of claim 2, wherein the plastic matrix has an outer diameter ranging from about 0.35 to about 0.90 millimeters.

5. The lightweight composite electrical conductor of claim 1, which comprises: a plastic core; a plurality of electrical conductors circumferentially surrounding an outer surface of the plastic core, wherein at least some of the electrical conductors circumferentially surround and touch the outer surface of the plastic core; and at least one insulating layer circumferentially surrounding the plurality of electrical conductors.

6. The lightweight composite electrical conductor of claim 5, wherein the plastic core is a solid or substantially solid plastic core.

7. The lightweight composite electrical conductor of claim 5, wherein the plastic core is a hollow tubular plastic core.

8. The lightweight composite electrical conductor of claim 7, which further comprises a fibrous strength member located within the hollow tubular plastic core, wherein the fibrous strength member is prepared from fibers selected from the group of aramid fibers, polyamide fibers, polyester fibers, and combinations thereof.

9. The lightweight composite electrical conductor of claim 5, wherein the plastic core is prepared from a material selected from the group of liquid crystal polymers, polyether ether ketone resins, polyether sulfone, polyimide, polyimide-amide plastic materials, and combinations thereof.

10. The lightweight composite electrical conductor of claim 9, wherein the plastic core is prepared from one or more polyether ether ketone resins.

11. The lightweight composite electrical conductor of claim 5, wherein the plastic core has an outer diameter ranging from about 0.25 to about 1.00 millimeters.

12. The lightweight composite electrical conductor of claim 5, wherein the plastic core has an outer diameter ranging from about 2.80 to about 15.00 millimeters.

13. The lightweight composite electrical conductor of claim 1, wherein the plurality of electrical conductors are stranded conductive materials selected from the group of stranded copper, copper alloys, nickel, nickel-clad copper, nickel-plated copper, silver, silver-plated copper, tin-plated copper and tin.

14. The lightweight composite electrical conductor of claim 13, wherein the plurality of electrical conductors are prepared from stranded tin-plated copper.

15. The lightweight composite electrical conductor of claim 1, wherein the insulating layer is a fluoropolymer insulating layer.

16. The lightweight composition electrical conductor of claim 15, wherein the fluoropolymer material used to prepare the insulating layer is selected from the group of perfluoromethylvinylether, perfluoroalkoxy, polytetrafluoroethylene, ethylene-chlorotrifluoroethylene copolymers, ethylene-tetrafluoroethylene copolymers and terpolymers, polyvinylidene fluoride, tetrafluoroethylene-hexafluoropropylene-vinylidene fluoride, polyvinylfluoride resins, and combinations thereof.

17. The lightweight composition electrical conductor of claim 16, wherein the fluoropolymer material is an ethylene-tetrafluoroethylene copolymer which comprises 35 to 60 mole % of units derived from ethylene, 35 to 60 mole % of units derived from tetrafluoroethylene and up to 10 mole % of units derived from one or more fluorinated comonomers.

18. The lightweight composite electrical conductor of claim 15, wherein the fluoropolymer insulating layer is formed by extruding a fluoropolymer material along a portion or length of the polymer matrix, or the plurality of electrical conductors circumferentially surrounding the plastic core.

19. The lightweight composite electrical conductor of claim 18, wherein the fluoropolymer material used to form the insulating layer comprises from about 4 to about 16% by weight of a crosslinking agent.

20. The lightweight composite electrical conductor of claim 18, wherein the fluoropolymer material used to form the insulating layer comprises a photosensitive substance, which renders the insulating layer receptive to laser marking.

21. The lightweight composite electrical conductor of claim 15, wherein the fluoropolymer insulating layer is formed by wrapping a fluoropolymer film, in an overlapping fashion, along a portion or length of the polymer matrix, or the plurality of electrical conductors circumferentially surrounding the plastic core.

22. The lightweight composite electrical conductor of claim 1, which has an outer diameter ranging from about 0.40 to about 1.62 millimeters, and which weighs from about 1.0 to about 7.0 kilograms per kilometer.

23. The lightweight composite electrical conductor of claim 1, which has an outer diameter ranging from about 3.28 to about 18.50 millimeters, and which weighs from about 11.5 to about 950 kilograms per kilometer.

24. A lightweight composite electrical conductor that comprises:

(a) a solid or substantially solid plastic core prepared from one or more polyether ether ketone resins;

(b) a plurality of stranded tin-plated copper wires contained in a single layer that circumferentially surrounds and touches an outer surface of the plastic core; and (c) at least one extruded, crosslinked ethylene tetrafluoroethylene copolymer insulating layer, wherein one insulating layer circumferentially surrounds and touches the layer formed by the stranded tin-plated copper wires.

25. A lightweight composite electrical conductor that comprises:

(a) a hollow tubular plastic core prepared from one or more polyether ether ketone resins;

(b) a plurality of stranded tin-plated copper wires contained in a single layer that circumferentially surrounds and touches an outer surface of the plastic core; and (c) at least one extruded, crosslinked ethylene tetrafluoroethylene copolymer insulating layer, wherein one insulating layer circumferentially surrounds and touches the layer formed by the stranded tin-plated copper wires.

26. A cable incorporating one or more lightweight composite electrical conductors, wherein the one or more lightweight composite electrical conductors each consist essentially of:

(a) a plastic matrix or plastic core;

(b) a plurality of electrical conductors either (i) embedded and fixed in place within the plastic matrix or (ii) circumferentially surrounding an outer surface of the plastic core, wherein at least some of the electrical conductors circumferentially surround and touch the outer surface of the plastic core; and (c) at least one insulating layer circumferentially surrounding the plastic matrix or the plurality of electrical conductors.

27. A lightweight composite electrical conductor that consists essentially of:

(a) a solid or substantially solid plastic core prepared from one or more polyether ether ketone resins;

(b) a plurality of stranded tin-plated copper wires contained in a single layer that circumferentially surrounds and touches an outer surface of the plastic core; and (c) at least one extruded, crosslinked ethylene tetrafluoroethylene copolymer insulating layer circu inferentially surrounding the layer formed by the stranded tin-plated copper wires.

28. A lightweight composite electrical conductor that consists essentially of:

(a) a hollow tubular plastic core prepared from one or more polyether ether ketone resins;

(b) a plurality of stranded tin-plated copper wires contained in a single layer that circumferentially surrounds and touches an outer surface of the plastic core; and (c) at least one extruded, crosslinked ethylene tetrafluoroethylene copolymer insulating layer circumferentially surrounding the layer formed by the stranded tin-plated copper wires.

* * * * *